US011073268B1

(12) United States Patent
Xu

(10) Patent No.: US 11,073,268 B1
(45) Date of Patent: Jul. 27, 2021

(54) DOUBLE-SIDED LED PANEL LIGHT

(71) Applicant: ZhiSheng Xu, Philadelphia, PA (US)

(72) Inventor: ZhiSheng Xu, Philadelphia, PA (US)

(73) Assignee: GVM Photographic Equipment Inc., Philadelphia, PA (US)

( * ) Notice: Subject to any disclaimer, the term of this patent is extended or adjusted under 35 U.S.C. 154(b) by 0 days.

(21) Appl. No.: 17/081,119

(22) Filed: Oct. 27, 2020

(51) Int. Cl.

| | |
|---|---|
| ***F21V 23/00*** | (2015.01) |
| ***F21V 21/30*** | (2006.01) |
| ***F21V 11/00*** | (2015.01) |
| ***F21V 29/70*** | (2015.01) |
| ***F21Y 113/13*** | (2016.01) |
| ***F21Y 105/16*** | (2016.01) |
| ***F21Y 107/90*** | (2016.01) |
| ***F21Y 115/10*** | (2016.01) |

(52) U.S. Cl.
CPC ..... *F21V 23/003* (2013.01); *F21V 11/00* (2013.01); *F21V 21/30* (2013.01); *F21V 29/70* (2015.01); *F21Y 2105/16* (2016.08); *F21Y 2107/90* (2016.08); *F21Y 2113/13* (2016.08); *F21Y 2115/10* (2016.08)

(58) Field of Classification Search
CPC ..... F21V 23/003; F21V 29/70; F21V 21/30; F21V 11/00; F21Y 2115/10; F21Y 2113/13; F21Y 2105/16; F21Y 2107/90
See application file for complete search history.

(56) References Cited

U.S. PATENT DOCUMENTS

| | | | | |
|---|---|---|---|---|
| 8,201,955 | B2 * | 6/2012 | Fong | G03B 15/02 362/18 |
| 8,469,546 | B2 * | 6/2013 | Pedersen | F21V 21/30 362/249.03 |
| 8,596,836 | B2 * | 12/2013 | Pedersen | F21V 21/30 362/373 |
| 10,641,463 | B2 * | 5/2020 | Rasmussen | F21V 23/003 |
| 10,760,748 | B2 * | 9/2020 | Liu | F21V 21/30 |
| 2016/0084485 | A1 * | 3/2016 | Bowcutt | F21L 4/00 362/191 |
| 2016/0320036 | A1 * | 11/2016 | Clark | F21V 23/008 |
| 2019/0234587 | A1 * | 8/2019 | Ohara | F21V 21/406 |
| 2019/0353332 | A1 * | 11/2019 | You | F21V 23/0414 |

* cited by examiner

*Primary Examiner* — Peggy A Neils
(74) *Attorney, Agent, or Firm* — Benjamin Aaron Adler

(57) ABSTRACT

Provided herein are double-sided panel lights, for example, double-sided LED panel lights. The panel lights have a body with a light emitting portion and a control portion. The light emitting portion has a light board on the front surface and on the back surface, where each light board contains a different light group such as an RGB light group and a two-color light group, and a support frame rotatably connected thereto. Transparent panels may cover the light boards. At least one light blocking plate may be removably attached to the light emitting portion. The control portion has a control module and a power module.

14 Claims, 4 Drawing Sheets

DOUBLE-SIDED LED PANEL LIGHT

BACKGROUND OF THE INVENTION

Field of the Invention

The invention relates to the fields of photography lights and LED panel lights. More specifically, the present invention is directed to a double-sided LED panel light.

Description of the Related Art

Photography lights or camera panel lights have diverse applications in the photography industry. Photography lights or camera panel lights primarily serve to provide an auxiliary light source when shooting in the absence of optimal light conditions to shoot acceptable pictures. The camera panel light has excellent control performance, for example, for adjusting brightness and color temperature and displaying the power remaining.

Presently, there are different camera panel lights in photography each suitable for creating a different scene. For example, two-color camera panel lights are common when doing news interviews. Similarly, when shooting outdoors, different camera panel lights of different colors are used depending on the needs of the scene. For example RGB lights are more commonly used. Currently, the commonly used two-color panel light and RGB light are overall large, bulky lights. Therefore, to conduct interviews and shoot outdoors, both a two-color panel light and an RBG light must be carried to wherever need, which is inconvenient for the staff.

Thus, there is a need in the art for an improved, portable and low cost panel light combining a two-color panel light and an RGB light to facilitate portability. Specifically, the prior art is deficient in a double-sided LED panel light with different light groups on each side controlled by a single control module. The present invention fulfills this longstanding need and desire in the art.

SUMMARY OF THE INVENTION

The present invention is directed to a double-sided panel light. The double-sided panel light comprises a body having a light emitting portion and a control portion. A first light board is disposed on a front surface of the light emitting portion and a second light board is disposed on a back surface thereof where both of the first light board and the second light board are operably connected to the control portion. A control module and a power module comprise the control portion. A support frame is rotatably connected to the light emitting portion of the body at opposite edges thereon.

The present invention is directed to a related double-sided panel light further comprising a first transparent panel disposed in a covering relationship with the first light board and a second transparent panel disposed in a covering relationship with the second light board. The present invention is directed to another related double-sided panel light further comprising at least one light blocking plate each removably attached to an edge of the light emitting portion. The present invention is directed to yet another related double-sided panel light where the body is made of a metal and where the double-sided panel light further comprises a heat sink disposed in the light emitting portion of the body between the first light board and the second light board.

The present invention also is directed to a double-sided LED panel light. The double-sided panel light comprises a metal body, a support frame rotatably connected to opposite edges of the light emitting portion and at least one light blocking plate removably attached to the light emitting portion. The metal body comprises a light emitting portion, a pair of LED light boards each comprising a different light group thereon, where one of the pair disposed on a front surface of the light emitting portion and the other disposed on a back surface thereof and a control portion comprising a control module and a power module operably connected to the LED light boards.

The present invention is directed to a related double-sided LED panel light further comprising a pair of transparent panels where each of the pair are disposed in a covering relationship to one of the pair of LED light boards. The present invention is directed to another related double-sided LED panel light further comprising a heat sink disposed within the metal body between the pair of LED light boards.

The present invention is directed further to another double-sided LED panel light. The double-sided LED panel light comprises a metal body and a support frame rotatably connected to opposite edges of the light emitting portion. The metal body comprises a light emitting component comprising a front surface and a back surface each with an LED light board disposed thereon, where each of the LED light boards comprises a different light group, a heat sink disposed within the metal body between the front surface and the back surface, a transparent panel disposed in a covering relationship over each of the LED light boards, at least one light blocking plate removably attached to an edge of the light emitting portion, and a control component comprising a control module, a power module, a function adjustment knob and a display operably connected to the LED light boards.

Other and further aspects, features, benefits, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be had by reference to certain embodiments thereof that are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

Figure 1:
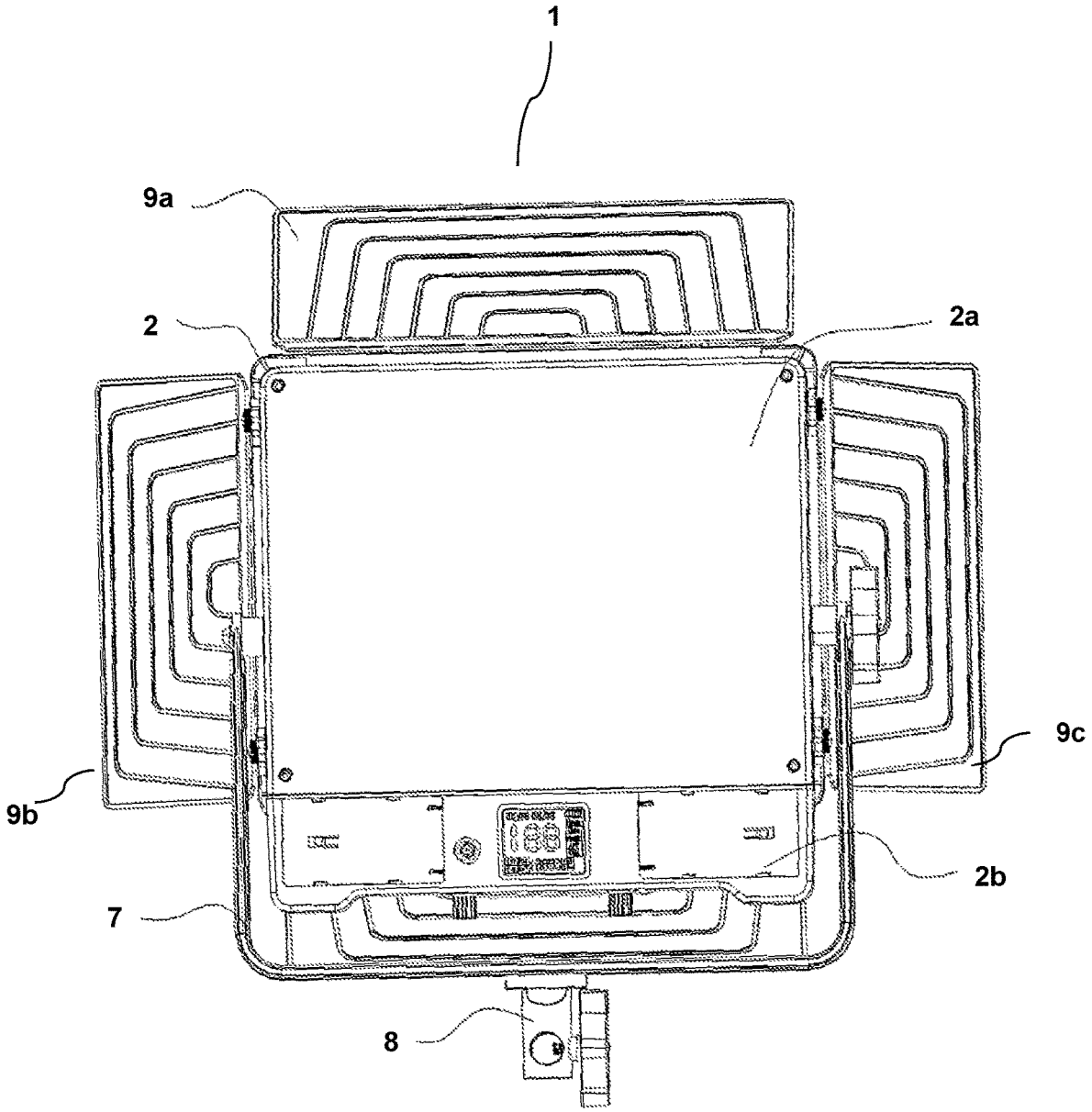
FIG. 1 is a schematic diagram of the overall structure of the double-sided LED panel light.

As used herein in the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein "or" in the claims refers to "and/or" unless explicitly indicated to refer to alternatives only or the alternatives are mutually exclusive, although the disclosure supports a definition that refers to only alternatives and "and/or".

As used herein "comprise" and "comprising" are used in the inclusive, open sense, meaning that additional elements may be included.

In one embodiment of the present invention there is provided a double-sided panel light, comprising a body having a light emitting portion and a control portion; a first light board disposed on a front surface of the light emitting portion and a second light board disposed on a back surface thereof, both of said first light board and said second light board operably connected to the control portion; a control module and a power module comprising the control portion; and a support frame rotatably connected to the light emitting portion of the body at opposite edges thereon.

Further to this embodiment the double-sided panel light may comprise a first transparent panel disposed in a covering relationship with the first light board; and a second transparent panel disposed in a covering relationship with the second light board. In another further embodiment the double-sided panel light may comprise at least one light blocking plate each removably attached to an edge of the light emitting portion. In yet another further embodiment the body is made of a metal where the double-sided panel light may comprise a heat sink disposed in the light emitting portion of the body between the first light board and the second light board.

In all embodiments the first light board and the second light board each may comprise a light group that is independently LED beads or LED patches. Also in all embodiments the first light board may comprise an RGB light group and the second light board comprises a two-color light group. In addition the control module may be operably connected to the first light board and to the second light board and electrically connected to the power module. In one aspect of all embodiments the control portion further may comprise a display and a function adjustment knob operably connected thereto. In another aspect the support frame further may comprise means for connecting the support frame to a stand, a tripod, a pole, or a rail.

In yet another embodiment of the present invention there is provided a double-sided LED panel light, comprising a metal body comprising a light emitting portion; a pair of LED light boards each comprising a different light group thereon, one of said pair disposed on a front surface of the light emitting portion and the other disposed on a back surface thereof; and a control portion comprising a control module and a power module operably connected to the LED light boards; a support frame rotatably connected to opposite edges of the light emitting portion; and at least one light blocking plate removably attached to the light emitting portion.

Further to this embodiment the double-sided LED panel light may comprise a pair of transparent panels, each of the pair disposed in a covering relationship to one of the pair of LED light boards. In another further embodiment the double-sided LED panel light may comprise a pair of transparent panels where each of the pair is disposed in a covering relationship to one of the pair of LED light boards. In yet another further embodiment the double-sided LED panel light may comprise a heat sink disposed within the metal body between the pair of LED light boards.

In all embodiments of the present invention each of the light groups independently may comprise LED beads or LED patches. Also in all embodiments the light board disposed on the front surface of the light emitting portion may comprise an RGB light group and the light board disposed on the back surface of the light emitting portion may comprise a two-color light group. In one aspect of all embodiments the control portion further may comprise a display and a function adjustment knob operably connected thereto. In another aspect the support frame further may comprise means for connecting the support frame to a stand, a tripod, a pole, or a rail.

In yet another embodiment of the present invention there is provided a double-sided LED panel light, comprising a metal body comprising a light emitting component comprising a front surface and a back surface each with an LED light board disposed thereon, each of said LED light boards comprising a different light group; a heat sink disposed within the metal body between the front surface and the back surface; a transparent panel disposed in a covering relationship over each of the LED light boards; at least one light blocking plate removably attached to an edge of the light emitting portion; and a control component comprising a control module, a power module, a function adjustment knob and a display operably connected to the LED light boards; and a support frame rotatably connected to opposite edges of the light emitting portion.

In this embodiment each of the light groups independently may be LED beads or LED patches. Also in this embodiment the light board disposed on the front surface of the light emitting portion may comprise an RGB light group and the light board disposed on the back surface of the light emitting portion comprises a two-color light group. In an aspect of this embodiment the support frame may further comprise means for connecting the support frame to a stand, a tripod, a pole, or a rail.

Provided herein is a double-sided panel light, particularly, a double-sided LED panel light. That the panel light is double-sided solves the problems encountered that operators of the panel lights need to use different lights in different work scenarios, requiring that they must carry a large number of different lights. The double-sided LED panel has a wide application range, a simple structure, a small size, is easy to carry, saves materials, reduces production costs, reduces losses, increases service life, and helps the environment in saving energy and reducing light pollution problems.

More particularly, the double-sided LED panel light has the following advantages.

Double-sided light emission can be achieved. In the double-sided LED panel light, LED light groups are provided on both the front and back sides of the light-emitting portion. The LED light group is a two-color group and an RGB group, which enables light emission on both sides.

There are a wide range of applications. The double-sided LED panel light has a double-sided light design where two-color lights on one side may be used for interviews because of the high brightness and high display index. RGB lights on the other side, under the control of the control module, achieve a variety of scene modes, for example, but not limited to, lightning, police cars, candlelight, television, party venues, and/or news reporting.

The structure is simple and the volume is small. Generally, the double-sided LED panel light includes a body with a heat sink, two LED light groups, a pair of transparent panels, one to three light blocking plates, a support frame, and a shared control system and power supply thereby, making the overall volume smaller.

The double-sided LED panel light is convenient to carry. The double-sided combination of two-color panel light and RGE light eliminates the need to carry a variety of different lights or lamps to an interview or an outdoor shoot. The two-color and RGB light groups meet various tasks requirements.

The double-sided LED panel light saves materials and reduces production costs because it can realize double-sided light emission. In terms of structure, the double-sided LED panel light shares a power supply, a heat sink, and a set of control systems, which effectively saves production materials and reduces production costs. In addition, the components used are conventional components, which have a wide range of sources and low costs, thereby effectively reducing the cost of the present invention.

There is a reduction in loss and an increase in service life. The body of the LED panel light is made of a metal material, for example, but not limited to, an aluminum alloy material with heat sink disposed within. This provides good structural strength and a good heat dissipation effect. This reduces loss, thereby making the service life of the double-sided LED panel light longer.

The double-sided LED panel light is energy saving, environment protecting and reduces the problem of light pollution. The LED light groups comprise LED lamp beads or LED patches to avoid, for example, the energy waste of tungsten filament lamps, low efficiency, short service life, and serious light pollution. Particularly, the problem of light pollution is greatly reduced.

The double-sided LED panel light is convenient and practical. The power module includes a battery interface and a power interface. The settings on the battery interface and the power interface enable the LED panel light to directly connect to the power supply or to use the battery so that an operator can immediately use the double-sided LED panel light indoors or outdoors.

Particularly, embodiments of the present invention are better illustrated with reference to the Figure(s), however, such reference is not meant to limit the present invention in any fashion. The embodiments and variations described in detail herein are to be interpreted by the appended claims and equivalents thereof.

FIG. 1 shows a double-sided LED panel light 1. The double-sided LED panel light comprises a body 2 with a light emitting portion 2*a*, zone or area and a control portion 2*b*, zone or area. The body may be made of a metal material, for example, an aluminum alloy, and may comprise a heat sink 3 in the middle thereof (see FIGS. 2, 4). A pair of LED light boards 4, 5 are disposed on the light emitting portion each with a transparent panel 6*a,b* covering the outside of the LED light boards (see FIG. 2). The control portion is at the lower end of the light emitting portion and comprises a control module and a power module (see FIG. 3).

Figure 3:
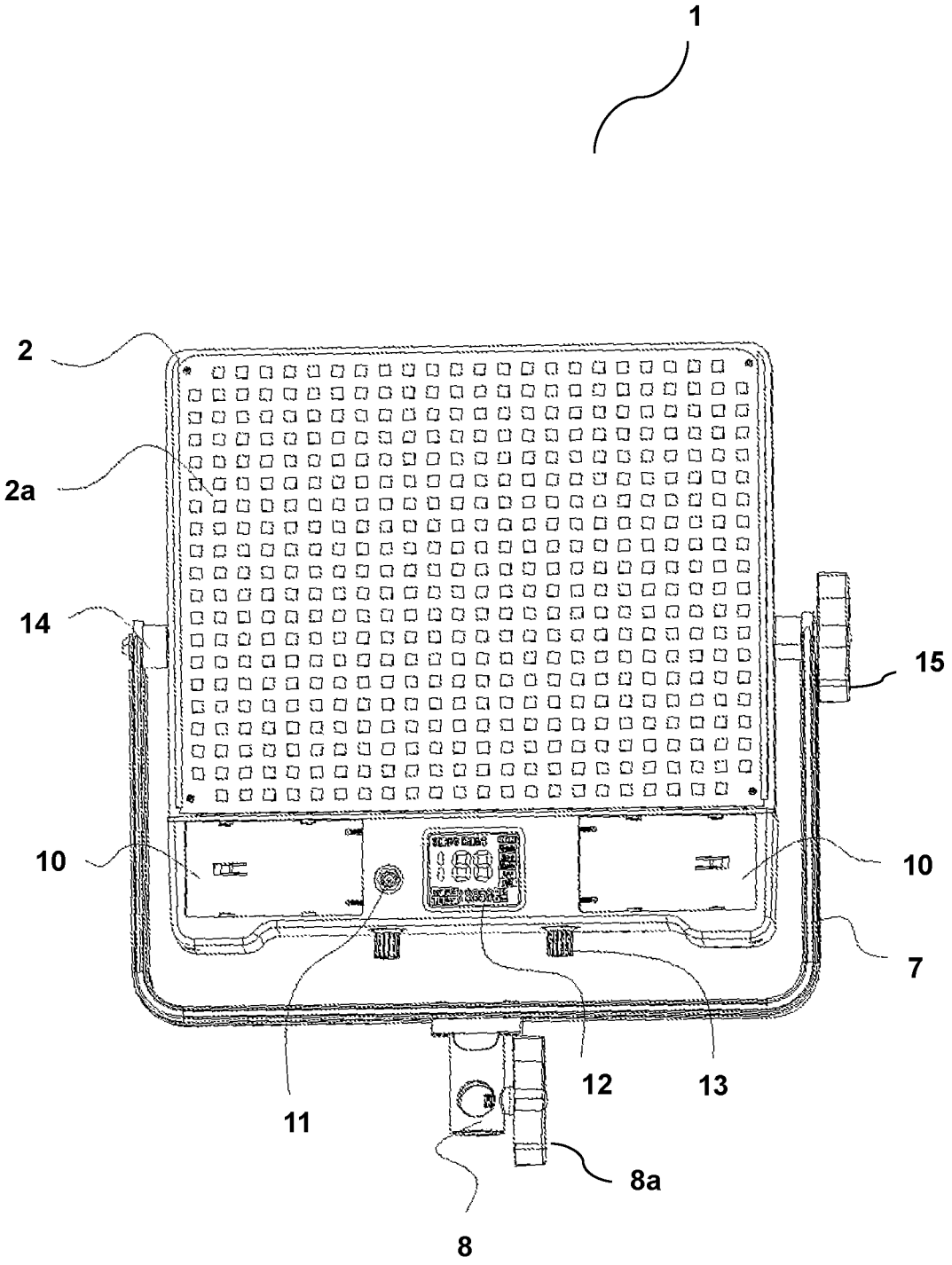
FIG. 3 is a schematic diagram of the front the double-sided LED panel light without the light blocking plates.

A support frame 7 is rotatably connected to the light emitting portion of the support frame (see FIG. 3). The support frame comprises means for attaching 8 or an interface depending therefrom by which the double-sided LED panel light may be removably mounted and secured to a stand, a tripod, a pole, or a rail. Light blocking plates 9*a,b,c* are disposed on the edges of the light emitting portion of the body. The light blocking plates are detachable and one, two or three of the light blocking plates may be removed and reattached as needed.

Figure 2:
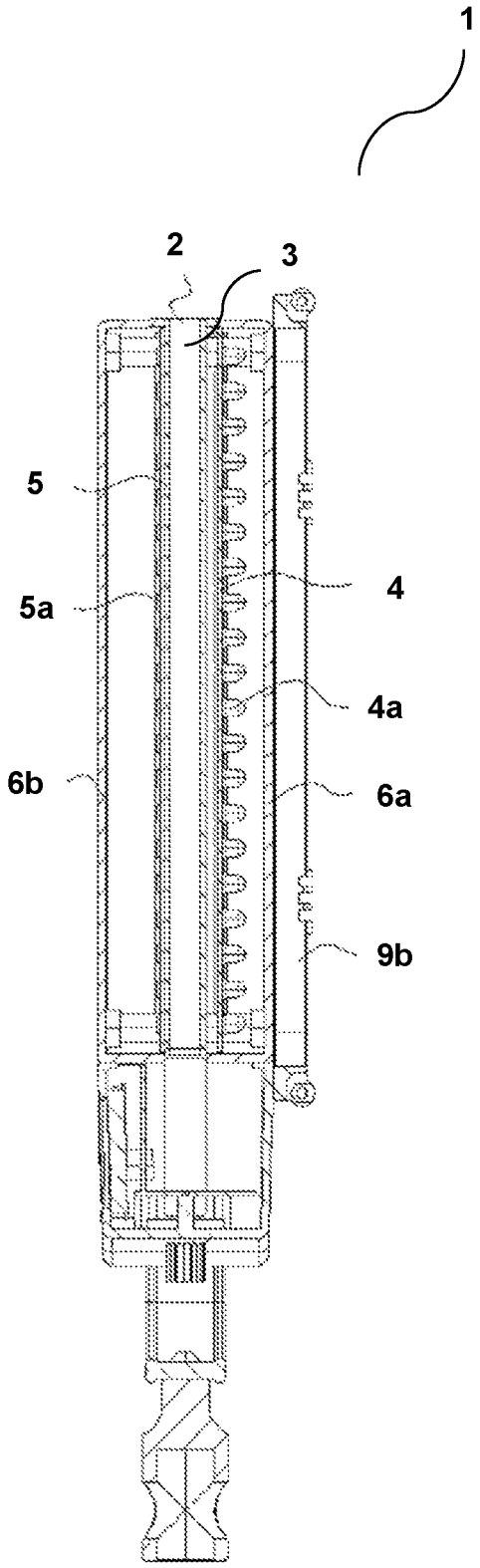
FIG. 2 is a cross-sectional view of the double-sided LED panel light.

With continued reference to FIG. 1, FIG. 2 is a cross-sectional view of the double-sided LED panel light 1. The positioning of the LED light boards 4, 5 with the transparent panels 6*a,b* and the light blocking plate 9*a* and the location of the heat sink 3 on the body 2 are illustrated. The LED light board 4 is disposed or positioned on the front surface of the light-emitting portion 2*a* and comprises a front LED light group 4*a* and LED light board 5 is disposed or positioned on the back surface of the light-emitting portion and comprises a back LED light group 5*a*. Transparent panel 6*a* covers the front LED light board and protects the front LED light group and transparent panel 6*b* covers the back LED light board and protects the back LED light group. The arrangement of the transparent panels guide the light from the LED light groups and protects the LED light groups from being damaged by external objects. The LED light groups on each LED light board independently may be or may comprise LED patches or LED beads. For example, the front LED light group may be an RGB patch and the back LED light group may be a two-color patch.

With continued reference to FIG. 1, FIG. 3 is a front view of the double-sided LED panel light 1 with the light blocking plates removed from the light emitting portion of the body. The control portion 2*b* of the body comprises a control module having a main control circuit board and a power module. The main control circuit board and the front LED light group, and the back LED light group are electrically connected to the power module which supplies power to the control module and to the LED light groups. The power module has a battery interface 10 and a power interface 11. The battery interface may be an NP-F series battery interface and the power interface may be a DC power interface. The double-sided LED panel light is thus dual-powered by a DC power supply and a lithium battery and may be directly connected to the power supply using a power cord or may be powered by a lithium battery The control portion also has an LCD display 12 and function adjustment knobs or buttons represented at 13 to adjust one or both of the LED light groups to accommodate, for example, the interview or other scene mode occurring outdoors. The setting of the function adjustment knob and/or buttons facilitates the adjustment to or the selection of functions. The LCD display 13 and the function adjustment knob are electrically connected to the main control circuit board, so that the double-sided LED panel light can be switched with one key to enable the characteristics of a multi-purpose light and full light coverage. The setting of the LCD display screen enables convenient checking of the selection of functions.

The attachment or securement of the support frame is better illustrated. The opposing ends are rotatably connected to the body 2 through the connecting seat 14 and fastened to the body by fastening screws that also enable adjustment of the angle of the double-sided LED panel light at knob 15. The attachment means 8 or interface comprises a knob 8*a* which enables adjustment of the installation angle of the double-sided LED panel light when mounted on, for example, a stand, a tripod, a light pole, or a rail.

Figure 4:
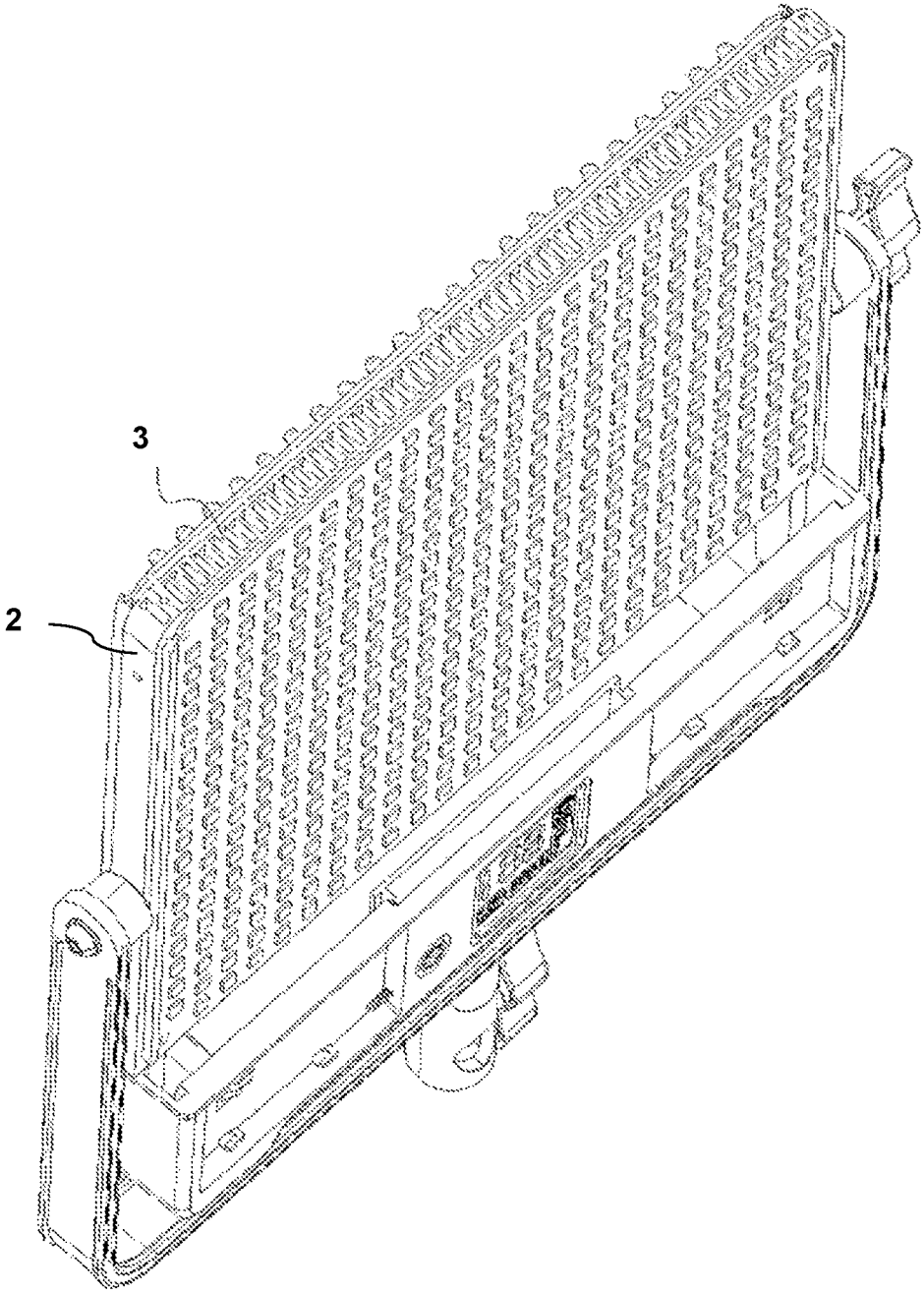
FIG. 4 is a schematic perspective view of the double-sided LED panel light illustrating the heat sink.

With continued reference to FIGS. 1 and 2, FIG. 4 is a top view of the double-side LED panel light 1 showing the placement of the heat sink 3 within the body 2. The heat sink is placed between the front surface and the back surface comprising the LED light boards, respectively, and continues from the top edge to the bottom edge of the light emitting portion. The heat sink enables dissipation of heat generated by the LED light groups during operation.

What is claimed is:

1. A double-sided panel light, comprising:

a metal body having a light emitting portion with a top edge and a bottom edge and a control portion disposed along the bottom edge and comprising a control module and a power module;

a first light board disposed on a front surface of the light emitting portion and a second light board disposed on a back surface thereof, both of said first light board and said second light board operably connected to the control portion;

a heat sink disposed in the light emitting portion of the body between the first light board and the second light board from the top edge of the light emitting portion to the bottom edge of the light emitting portion; and a support frame rotatably connected to the light emitting portion of the body at opposite edges thereon and comprising means for removably mounting the support frame and adjusting an installment angle thereof when mounted.

2. The double-sided panel light of claim 1, further comprising:

a first transparent panel disposed in a covering relationship with the first light board; and a second transparent panel disposed in a covering relationship with the second light board.

3. The double-sided panel light of claim 1, wherein the first light board and the second light board each comprises a light group that is independently LED beads or LED patches.

4. The double-sided panel light of claim 1, wherein the first light board comprises an RGB light group and the second light board comprises a two-color light group.

5. The double-sided panel light of claim 1, wherein the control portion further comprises a display and a function adjustment knob operably connected thereto.

6. The double-sided panel light of claim 1, wherein the control module is electrically connected to the power module.

7. A double-sided LED panel light, comprising:

a metal body comprising:

a light emitting portion has a top edge and a bottom edge and a control portion disposed along the bottom edge and comprising a control module and a power module operably connected to the LED light boards and electrically connected to the power module;

a pair of LED light boards each comprising a different light group thereon, one of said pair disposed on a front surface of the light emitting portion and the other disposed on a back surface thereof;

a heat sink disposed within the metal body between the pair of LED light boards from the top edge of the light emitting portion to the bottom edge of the light emitting portion;

a support frame rotatably connected to opposite edges of the light emitting portion and comprising means for removably mounting the support frame and adjusting an installment angle thereof when mounted; and at least one light blocking plate removably attached to the light emitting portion.

8. The double-sided LED panel light of claim 7, further comprising a pair of transparent panels, each of said pair disposed in a covering relationship to one of the pair of LED light boards.

9. The double-sided panel light of claim 7, wherein the light group comprises LED beads or LED patches.

10. The double-sided panel light of claim 7, wherein the light board disposed on the front surface of the light emitting portion comprises an RGB light group and the light board disposed on the back surface of the light emitting portion comprises a two-color light group.

11. The double-sided panel light of claim 7, wherein the control portion further comprises a display and a function adjustment knob operably connected thereto.

12. A double-sided LED panel light, comprising:

a metal body comprising:

a light emitting component comprising a front surface and a back surface, each with an LED light board disposed thereon, and a top edge and a bottom edge, each of said LED light boards comprising a different light group;

a heat sink disposed within the metal body between the front surface and the back surface from the top edge of the light emitting component to the bottom edge of the light emitting portion;

a transparent panel disposed in a covering relationship over each of the LED light boards;

at least one light blocking plate removably attached to an edge of the light emitting portion; and a control component disposed along the bottom edge of the light emitting component and comprising a control module, a power module, a function adjustment knob and a display operably connected to the LED light boards and electrically connected to the power module; and a support frame rotatably connected to opposite edges of the light emitting portion and comprising means for removably mounting the support frame and adjusting an installment angle thereof when mounted.

13. The double-sided LED panel light of claim 12, wherein the light group comprises LED beads or LED patches.

14. The double-sided LED panel light of claim 12, wherein the light board disposed on the front surface of the light emitting portion comprises an RGB light group and the light board disposed on the back surface of the light emitting portion comprises a two-color light group.

* * * * *